US008439242B2

(12) United States Patent
Tanji et al.

(10) Patent No.: US 8,439,242 B2
(45) Date of Patent: May 14, 2013

(54) FASTENING MACHINE

(75) Inventors: Isamu Tanji, Ibaraki (JP); Hideyuki Hashimoto, Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 789 days.

(21) Appl. No.: 12/233,828

(22) Filed: Sep. 19, 2008

(65) Prior Publication Data

US 2009/0084823 A1 Apr. 2, 2009

(30) Foreign Application Priority Data

Sep. 28, 2007 (JP) ..... 2007-256895

(51) Int. Cl.
*B25C 1/04* (2006.01)
*B25F 5/00* (2006.01)

(52) U.S. Cl.
USPC ..... 227/8; 227/9; 227/107; 227/113; 227/119; 227/120; 227/140; 227/156

(58) Field of Classification Search ..... 227/8–9, 227/107, 113, 119–120, 140, 156
See application file for complete search history.

(56) References Cited

U.S. PATENT DOCUMENTS

| | | | | |
|---|---|---|---|---|
| 1,950,356 | A * | 3/1934 | De Bats | 164/57.1 |
| 2,161,969 | A * | 6/1939 | Mange | 408/110 |
| 2,705,323 | A * | 4/1955 | Bossong | 227/11 |
| 3,743,158 | A * | 7/1973 | Cohn et al. | 227/8 |
| 4,452,387 | A * | 6/1984 | Haytayan | 227/8 |
| 4,566,619 | A * | 1/1986 | Kleinholz | 227/8 |
| 5,649,661 | A * | 7/1997 | Masuno et al. | 227/8 |
| 6,003,751 | A * | 12/1999 | Ohmae | 227/130 |
| 6,286,742 | B1 * | 9/2001 | Mukoyama | 227/8 |
| 6,578,750 | B2 * | 6/2003 | Kubo et al. | 227/142 |
| 6,698,644 | B2 * | 3/2004 | Lorenz | 228/131 |
| 6,776,322 | B2 * | 8/2004 | Villela et al. | 227/142 |

(Continued)

FOREIGN PATENT DOCUMENTS

| | | |
|---|---|---|
| JP | 02-041877 | 2/1990 |
| JP | 08-325676 | 12/1996 |
| JP | 2000-108052 | 4/2000 |

OTHER PUBLICATIONS

Japanese Office Action, and English translation thereof, issued in Japanese Patent Application No. 2007-256895 dated Dec. 17, 2011.

(Continued)

*Primary Examiner* — Brian D Nash
*Assistant Examiner* — Michelle Lopez
(74) *Attorney, Agent, or Firm* — McDermott Will & Emery LLP

(57) ABSTRACT

A fastening machine 1 is provided, which prevents the tip member 131 from wear and improve its durability as well as align a material into which a fastener is to be driven. The fastening machine 1 is provided with a housing 2, a handle 2A extended from the housing 2, a nose 3 extended from the housing 2 and comprising an ejecting mouth 6 to fire a fastener 25 and a tip member 131 arranged at the tip of nose 3 in the direction of ejecting the fastener 25. The tip member 131 is characterized by comprising a super-hard material member 19 in the side facing a material into which a fastener is to be driven and in the side opposite to the direction of extending the handle 2A.

16 Claims, 8 Drawing Sheets

U.S. PATENT DOCUMENTS

| | | | | |
|---|---|---|---|---|
| 7,255,256 | B2 * | 8/2007 | McGee et al. | 227/8 |
| 2004/0011845 | A1 * | 1/2004 | Walter | 227/120 |
| 2008/0290128 | A1 * | 11/2008 | Buetow | 227/8 |
| 2009/0039135 | A1 * | 2/2009 | Kubo | 227/120 |

OTHER PUBLICATIONS

Japanese Office Action, and English translation thereof, issued in Japanese Patent Application No. 2007-256895 dated Aug. 21, 2012.

* cited by examiner

FASTENING MACHINE

BACKGROUND OF THE INVENTION

1. Field of the Invention

The present invention relates to a fastening machine that drives a fastener or the like into a material.

2. Description of the Related Art

A fastening machine which drives a fastener, such as nails, into a material by using compressed air or the like as power (referred hereinafter to as a nail gun) is known. This kind of nail gun is provided with a nose on a housing that faces a material into which a fastener is driven. The nose is formed with an ejecting mouth and a push lever, which locks firing of the fastener when not in use, and by being pushed by a material into which a fastener is to be driven when used, releases the lock of firing of the fastener. A driver blade for firing the fastener is slidably arranged on the ejecting mouth of the nose. In this nail gun, a driver blade is driven by compressed air while the push lever being pushed onto the material into which the fastener is to be driven, to fire the fastener in the direction of the tip of the ejecting mouth to be driven into the material.

Incidentally, a material, of which a surface is coated with a gravel-containing tar, has been known as a material for a residential house for increasing its strength and maintaining waterproof properties. Typical examples of those include a sheet-like asphalt shingle used in a roof, a sheathing board used in a wall and the like. These are fastened to a base sheet with the fastener.

Regarding the nail gun described above, a nail gun equipped with an adjusting guide on a magazine unit has been disclosed, for example, in Japanese Unexamined Japanese Patent Application KOKAI Publication No. 2000-108052. The attaching work of fastening an asphalt shingle (a material into which a fastener is to be driven) to a base sheet using this nail gun will be briefly described below. An operator makes the front surface of the adjusting guide abut against the side end of a first asphalt shingle, into which a nail has been driven to fasten it to the base sheet to thereby secure the position of the housing. The end of a second asphalt shingle, into which a nail is driven to fasten to the base sheet is next abutted against the segment, where a nail is fired from a nail gun, thus matching the position of the second asphalt shingle. A nail is subsequently driven into the second asphalt shingle to fasten to the base sheet. At present, alignment according to the above method is in general widely used in the work to attach an asphalt shingle.

FIG. 8 also shows enlargement of the lower end of a push lever 13A in a conventional nail gun. This nail gun is provided with a tip member 131 at the tip of the lower end of push lever 13A. A super-hard material member 20 such as tungsten carbide and the like is provided on the surface of the tip member 131 facing a material 21 into which a fastener is to be driven. Furthermore, a chamfered section 24 is provided at the corner of the tip member 131. As described above, the second asphalt shingle 22 is aligned by making the end of second asphalt shingle 22 abut against the tip member 131 at the lower end of push lever 13A.

When this work is repeated for an extended period, the tip member in the push lever is worn to possibly shorten the tip member. When the tip member is worn, an operator cannot align the tip member and it further becomes difficult to readily align the material into which the fastener is to be driven using the nail gun, leading to undesirable results.

However, a chamfered section 24 of the conventional nail gun shown in FIG. 8 is more protruded than other sections, having more chance to contact with the gravel in an asphalt shingle, a wall and the like to wear out faster than other section after used for a longer period. When the chamfered section 24 is worn out, a radius of curvature of the chamfered section 24 becomes larger than thickness of the second asphalt shingle 22. As a result, the worn out chamfered section 24 runs on to the end of asphalt shingle 22. Consequently, alignment of the second asphalt shingle 22 becomes difficult and drastically reduces the working efficiency. An operator therefore replaces the lower end of push lever 13A whenever the chamfered section 24 of the tip member 131 is worn out, resulting in diminishing economic efficiency.

When wear in the lower end of push lever 13A progresses, the nail gun pushes the first asphalt shingle 21 at two locations, where a pair of the super-hard material members 20 protruded from the tip member 131 abuts against the first asphalt shingle 21, thereby failing to hold down and possibly form an unattached segment. In such a case, the lower end of push lever 13A also has to be replaced.

A super-hard material member is also generally expensive so that use of the super-hard material member has stayed at minimum. Therefore, structure of a conventional nail gun cannot effectively prevent the tip member 131 from wear.

SUMMARY OF THE INVENTION

The present invention has been carried out in relation to the actual conditions described above and has an object to provide a fastening machine provided with a wear-resistant tip member.

The present invention has another object to provide a fastening machine with high durability.

The fastening machine related to the present invention comprises:

a housing, a handle extended from the housing, a driver blade which is driven by a drive mechanism installed within the housing to fire a fastener, a nose with an ejecting mouth and an ejection passage extending from the housing which slidably guides the driver blade, a tip member arranged at the end of the nose in the direction of ejecting the fastener and having an opening at the location corresponding to the ejecting mouth, and a first super-hard material member provided in a side of the tip member, the side facing a material into which a fastener is to be driven, and being opposite to the extending direction of the handle.

The tip member of the fastening machine can prevent wear, and as well as improving its durability, and accurate alignment of a material into which a fastener is to be driven can be conducted.

DETAILED DESCRIPTION OF THE PREFERRED EMBODIMENT

Hereinafter, in order to clarify description related to the embodiments of the present invention, in the present embodiments the direction of ejecting the fastener, after moving a driver blade together with a piston, is defined as a direction of ejecting. A downward direction refers to the direction of ejecting, an upward direction to its opposite direction, a right-left direction to the direction orthogonal to both the extending direction of the handle from a housing and the ejecting direction, and a front-back direction for the direction orthogonal to both the ejecting direction and the right-left direction. Regarding the front-back direction, the direction in which the handle extends from the housing, and its opposite direction are referred to as a back direction and a front direction, respectively.

First Embodiment

Figure 1:
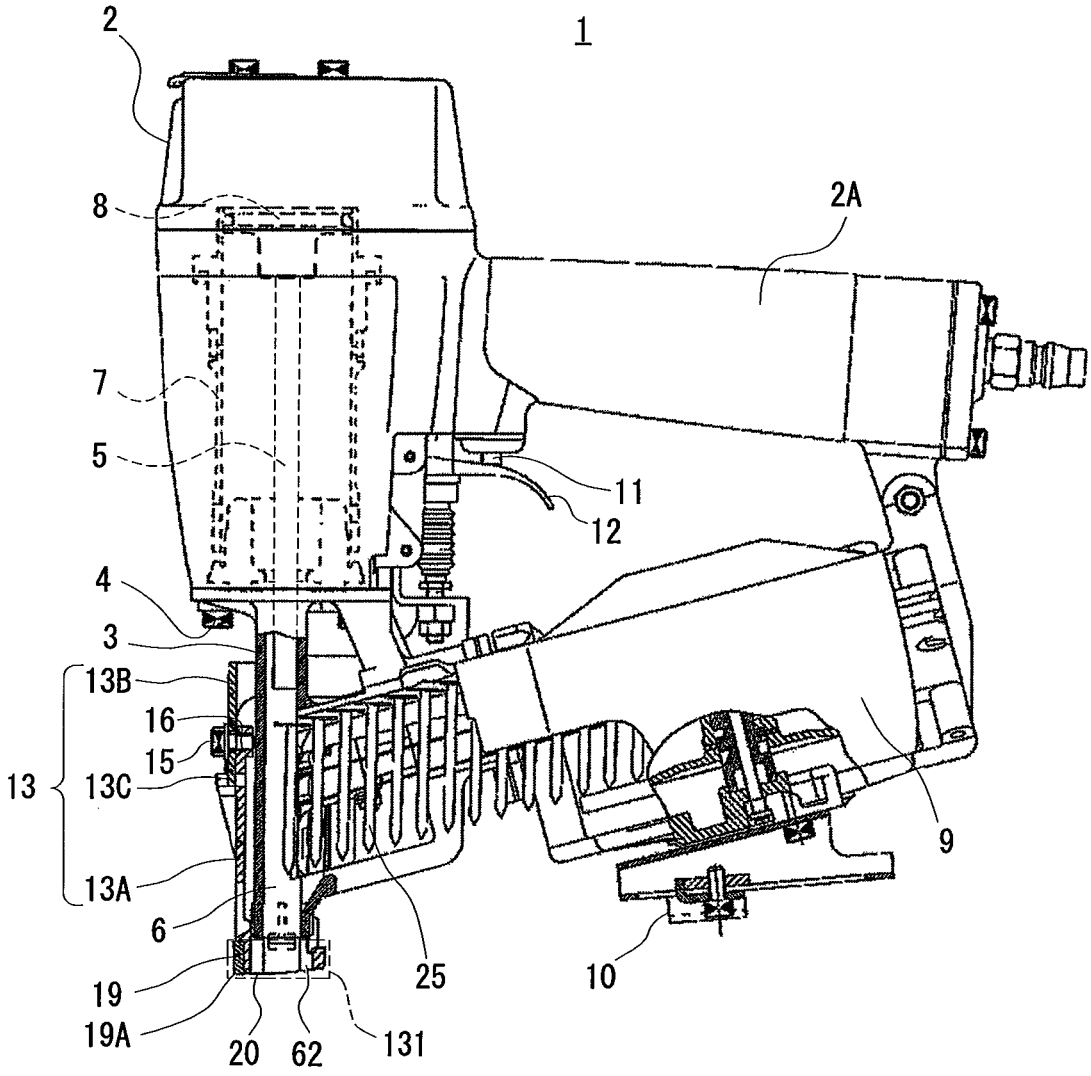
FIG. 1 is a partial sectional side view illustrating a fastening machine in a first embodiment of the present invention.
Figure 2:
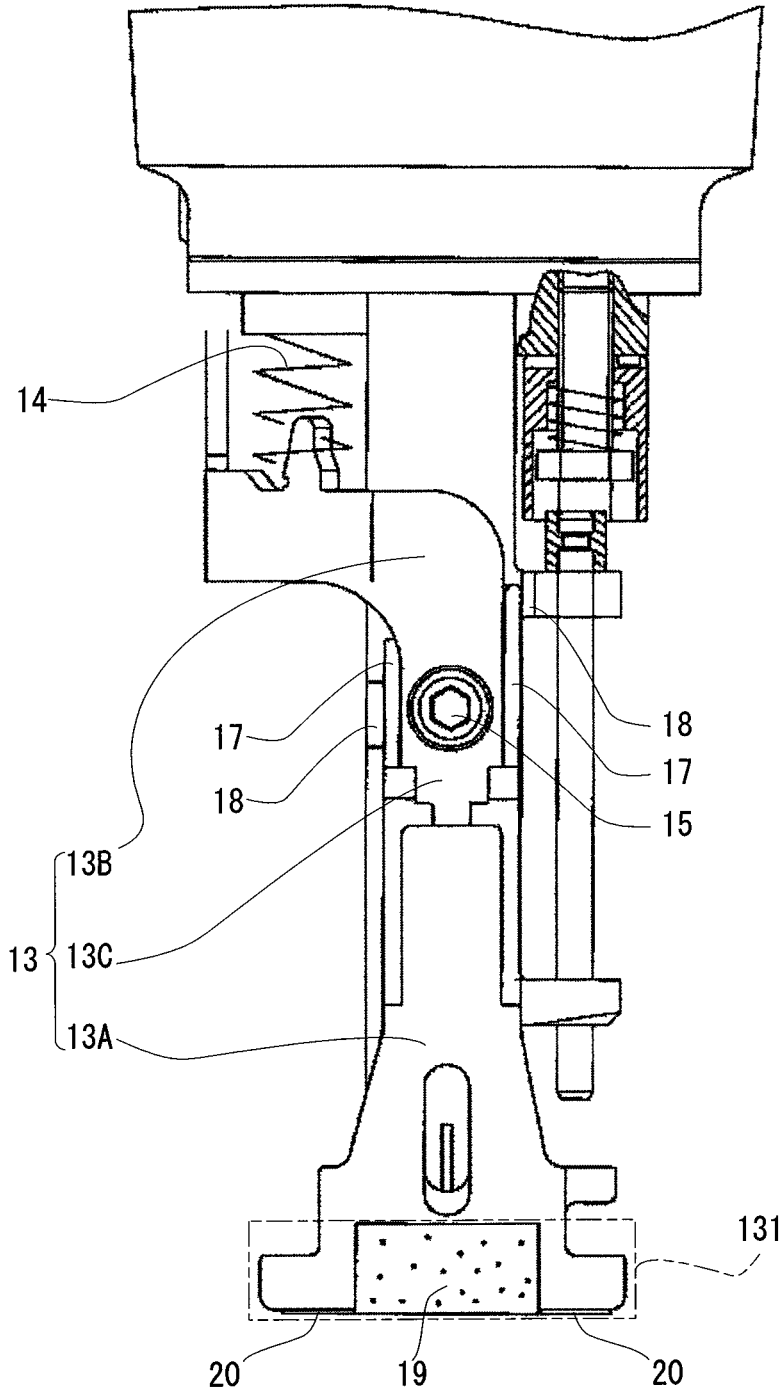
FIG. 2 is a partial sectional view illustrating a nose of the fastening machine in FIG. 1.
Figure 3:
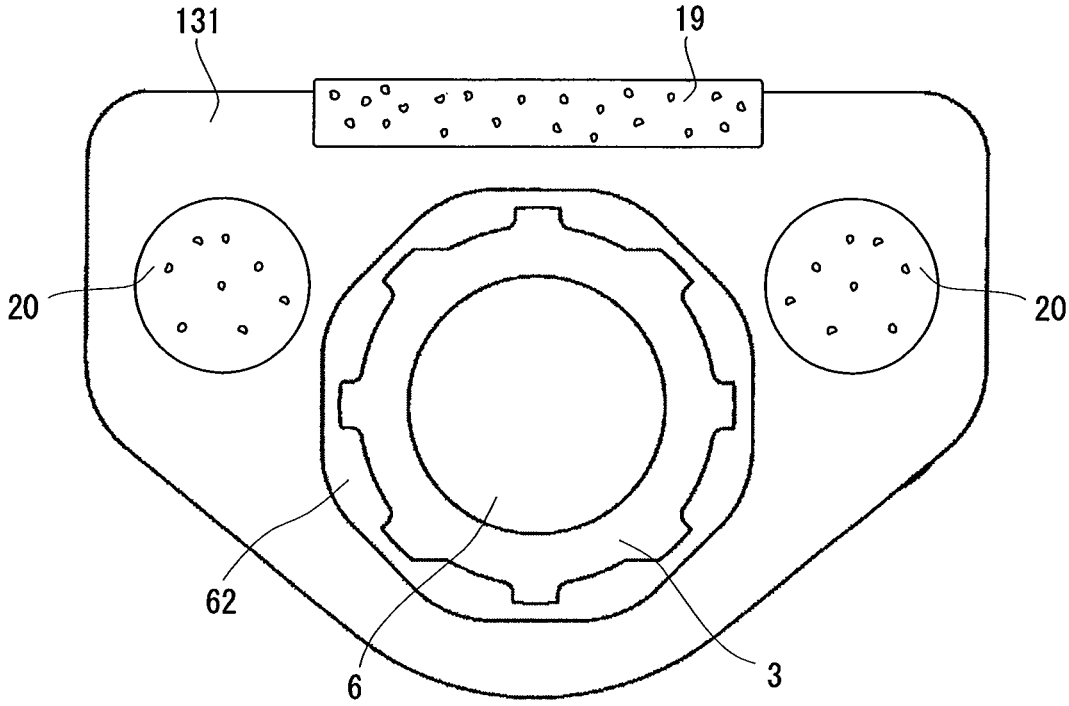
FIG. 3 is a bottom plan view illustrating the lower end of a push lever of the fastening machine in FIG. 2.

A nail gun related to the first embodiment of the present invention is described in reference with FIGS. 1 to 3.

FIG. 1 is a partial sectional side view illustrating a nail gun (fastening machine) 1 actuated by a source of power such as compressed air and the like to drive a fastener 25 such as nails and the like.

The nail gun 1 is integrally provided with a housing 2, a handle 2A positioned in one side of the housing 2 and a nose 3 positioned at the lower end of housing 2. The nose 3 is fixed with a bolt 4 to the lower part of housing 2 to form a cylindrical ejecting mouth 6, which slidably guides a driver blade 5.

An accumulator, not shown, is formed within the handle 2A and the housing 2 of the nail gun 1 in order to accumulate compressed air from an air compressor not shown. The accumulator is connected to the air compressor via an air hose not shown in the figures. A cylindrical cylinder 7 is set within the housing 2, a piston 8 is provided slidably up and down within the cylinder 7, and a driver blade 5 is integrally formed with the piston 8. A piston bumper not shown is set at the lower end of cylinder 7 in order to absorb excess energy of the piston 8 after driving in a nail 25. The piston 8 is positioned at the top dead point in an initial state and driven downwards with air pressure by pumping compressed air accumulated in the accumulator into the cylinder 7. The mechanism above is a driving mechanism in the present invention.

A magazine 9 loaded with nails 25 is connected to the nose 3 at the center rear. An adjusting guide part 10 is provided at the bottom surface of magazine 9 in order to determine the distance with a tip member 131. In the nail gun 1, the adjusting guide part 10 enables the alignment of a material into which a fastener is to be driven (second asphalt shingle 22 described subsequently). The adjusting guide part 10 can move in the front-back direction on the magazine 9. The adjusting guide part 10 is fixed at any location, allowing adjusting the distance with the tip member 131.

A plunger 11 controlling the driving mechanism, and a trigger 12 actuated by an operator, are set near the housing 2 of the handle 2A, and the upper end of a push lever 13 described below is positioned near the trigger 12. This is configured such that the driving mechanism is actuated when both operation of pulling the trigger 12 and operation of pushing the push lever 13 onto a material into which a fastener is to be driven, are conducted.

As shown in FIG. 2, the push lever 13 is set to extend from the vicinity of the housing 2 for the handle 2A to the tip of the nose 3 in the direction of ejecting and held slidably up and down along a guide rib 18 formed on the nose 3. The push lever 13 is held by a spring 14 to direct downwards and in the initial stage, the lower end of a push lever 13A is arranged to protrude further than the tip of the ejecting mouth 6 in the nose 3 in the lower direction. The tip member 131 related to the present invention is formed at the lower end of push lever 13A. During operation, the lower end of push lever 13A is contacted with a material into which a fastener is to be driven at the surface of tip member 131 formed at the end.

A connection segment 13C is formed at the lower end of push lever 13A in order to connect with the upper end of push lever 13B. The connection segment 13C is configured by a screw part 16 (refer to FIG. 1) to stop and fix the upper end of the push lever 13B with a bolt 15 and a pair of locking plates 17 to pinch the upper end of push lever 13B. A way of mounting the lower end of push lever 13A will be briefly described. An operator moves upwards the lower end of push lever 13A along the nose 3 from the nose tip and inserts into the inside of a guide rib 18 (refer to FIG. 2) formed in the nose 3 to fit. The operator herewith abuts the upper end of push lever 13B against the inside of locking plate at the lower end of push lever 13A to fit and connect by a bolt 15, completing to mount to the nail gun 1.

An opening 62 is set at the lower end of push lever 13A in order to maintain a space with the nose 3 for allowing inserting the nose 3 in operation of sliding the lower end of push lever 13A. The opening 62 is formed in a cross-section of an approximately octagonal shape as shown in FIG. 3, where eight planes parallel to the direction of ejecting are connected to form a gently curved plane. The nose 3 has eight protruded parts with a shape of convex rib on the peripheral plane and the ejecting mouth 6 at the center, thus forming a gear-shaped cross-section. The lower end of push lever 13A and the nose 3 are mounted such that each protrude part of the nose 3 faces each plane formed at the opening 62 in the lower end of push lever 13A above.

In the surface of contacting the tip member 131 in the lower end of push lever 13A with a material into which a fastener is to be driven, a sheet of a plate-shaped tungsten carbide chip (hereinafter referred to as super-hard material member 19) is arranged in front of the opening 62 and a pair of a disk-shaped tungsten carbide chips (hereinafter referred to as super-hard material member 20) is arranged at two locations symmetrically departing from the opening 62.

Figure 4:
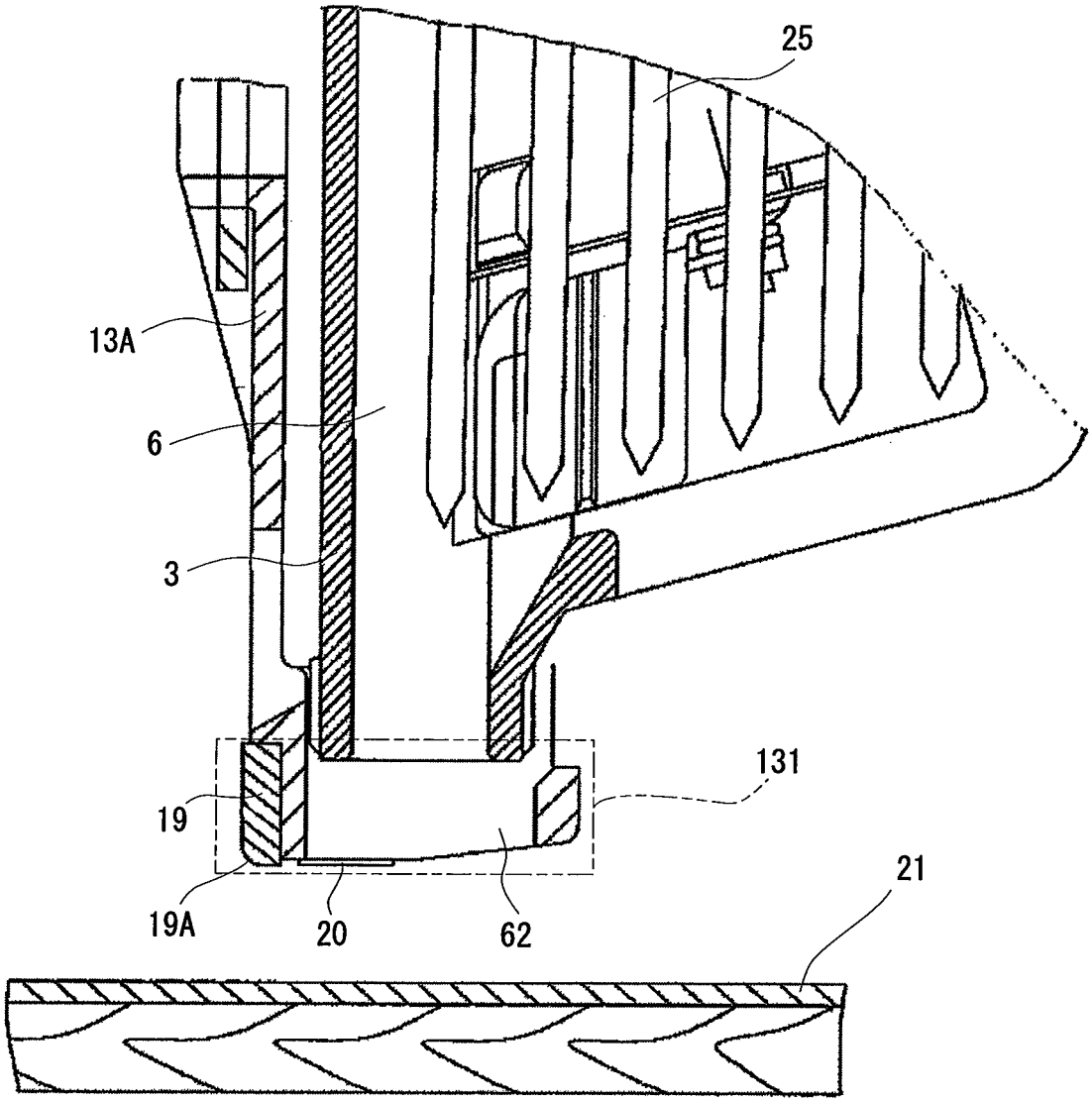
FIG. 4 is a sectional side view illustrating a nose of the fastening machine in FIG. 1.

As shown in FIGS. 2 to 4, the super-hard material member 19 is formed in a plate shape with an approximately square cross-section and covers part of the front surface of the lower end of push lever 13A. As shown in FIG. 3, a length of the super-hard material member 19 in the right-left direction is formed longer than the width of the ejecting mouth 6. Furthermore, as shown in FIG. 4, a chamfered part 19A with a radius of curvature smaller than a thickness of 2.0 mm for a general asphalt shingle, is formed at the front end of the super-hard material member 19 protruded from the lower end of push lever 13A.

A pair of the super-hard material members 20 each is arranged in the position overlapping the ejecting mouth 6 in the front-back direction. Each back end of a pair of the super-hard material members 20 is also arranged at the position behind the front surface of the tip member 131 in the lower end of push lever 13A by a length corresponding to approximately one third of the width in the front-back direction of the surface of the tip member 131 facing a material into which a fastener is to be driven.

The super-hard material member 19 is protruded by 0.3 mm from the lower end of push lever 13A in the front direction and the direction of ejecting. A pair of the super-hard material members 20 is protruded by 0.3 mm from the lower end of push lever 13A in the direction of ejecting. The super-hard material member 19 is thus arranged at the front end of the lower end of push lever 13A and a pair of the super-hard material members 20 is arranged at two locations symmetrically departing from the ejecting mouth 6, thereby determining the position to drive in the ejecting direction at a total of three locations on these super-hard material members 19, 20. Furthermore, three super-hard material members 19, 20 have a certain protruded quantity so that the surface connecting three super-hard material members 19, 20 is formed nearly perpendicular to the direction of ejecting.

Two kinds of metal with different melting temperatures are herein used to braze to fix a plurality of super-hard material members at different locations in the lower end of push lever 13A. In more detail, the super-hard material member 19 is placed in a concave portion formed at the front surface of the lower end of push lever 13A to be brazed with a copper brazing filler metal (melting temperature, 1100° C.). A pair of super-hard material members 20 is thereafter placed in a concave portion provided at two locations symmetrically departing from the opening 6 in the lower end of push lever 13A to be brazed with a silver brazing filler metal (melting temperature, 600° C.). Such methods prevent each super-hard material member 19, 20 from dropping from the tip member 131, firmly fixing to the lower end of push lever 13A and giving the nail gun 1 high durability. Furthermore, use of two or more kinds of brazing filler metals allows mounting a plurality of super-hard material members to the tip member 131 at different locations.

Figure 5:
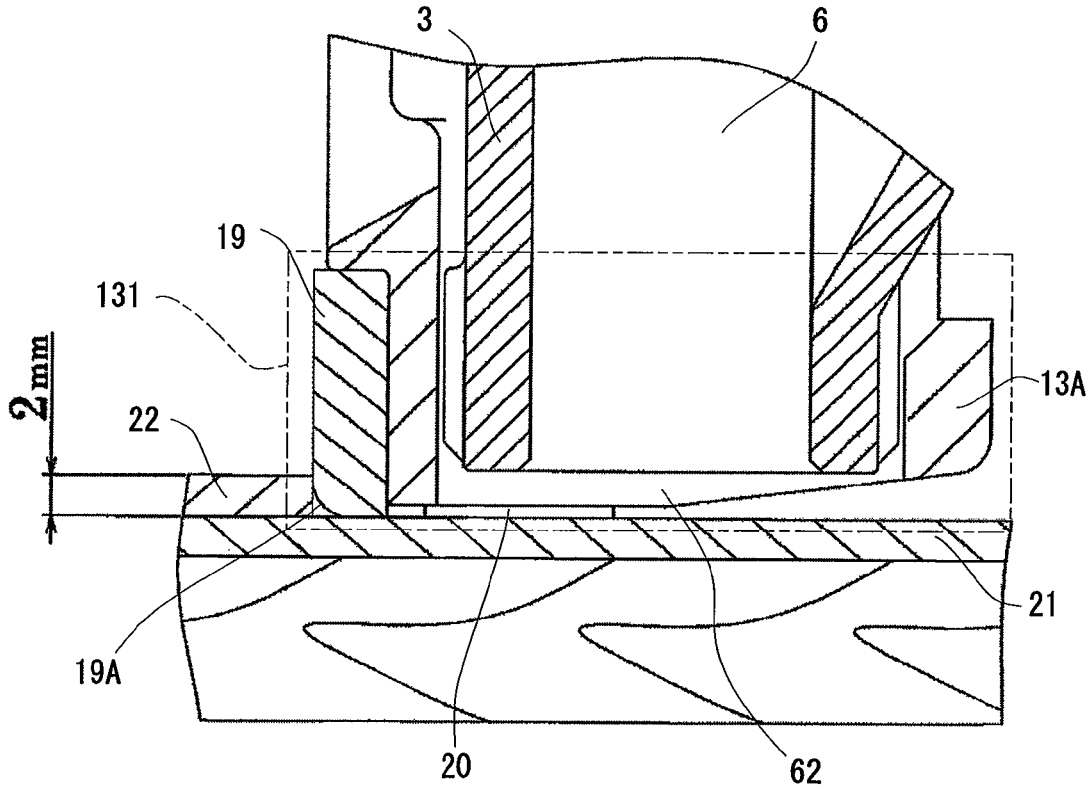
FIG. 5 is a sectional side view illustrating a work state in aligning a roof material by the fastening machine in FIG. 4.

Alignment of an asphalt shingle in the work of fastening the asphalt shingle using the nail gun 1 with the configuration as given in the first embodiment, will be described in reference with FIG. 5.

An operator locks the adjusting guide part 10 arranged at the lower part of the magazine 9 to the end of the first asphalt shingle 21 not shown, into which a nail 25 has been previously driven, securing the position of the housing 2. Furthermore, the end of the second asphalt shingle 22 to be next driven in is contacted with the front surface of the super-hard material member 19 in the lower end of push lever 13A to align with the second asphalt shingle 22 in the front-back direction.

The second asphalt shingle 22 next moves along the front surface of the super-hard material member 19 to align in its right-left direction. The position of the second asphalt shingle 22 in the front-back direction and the right-left direction is thus established by the adjusting guide 10 and the tip member 131 at the lower end of push lever 13A, which are provided for the nail gun 1, and by the first asphalt shingle 21.

Gravel on the surface of the asphalt shingles 21 and 22 do not interfere in aligning the second asphalt shingle 22 described above, since a chamfered portion 19A is formed on the super-hard material member 19. Since the chamfered portion 19A is smaller than 2.0 mm of thickness in a general asphalt shingle, it does not get on the second asphalt shingle 22 to ensure the alignment.

Pushing the chamfered portion 19A strongly onto the surface of the first asphalt shingle 21 or scraping its front surface with movement of the second asphalt shingle 22 from side to side does not wear the chamfered portion 19A, since it is part of the super-hard material member 19 such as tungsten carbide and the like. Therefore, accurate alignment can be achieved in spite of its use for an extended period. Contacting the super-hard material members 19, 20 with the first asphalt shingle 21 at three locations allows reliably holding down an unattached segment and easily carrying out alignment. Furthermore, the tip member 131 can stably abut against the first asphalt shingle 21 to easily carry out alignment, since the super-hard material member 19 in the right-left direction is formed longer than the ejecting mouth 6.

Furthermore, keeping a protruded quantity of three super-hard material members 19, 20 in the direction of ejecting prevents the super-hard material member from local contact pressure, thus allowing to prevent the particular portion of the lower end of push lever 13A from wear.

Second Embodiment

Figure 6:
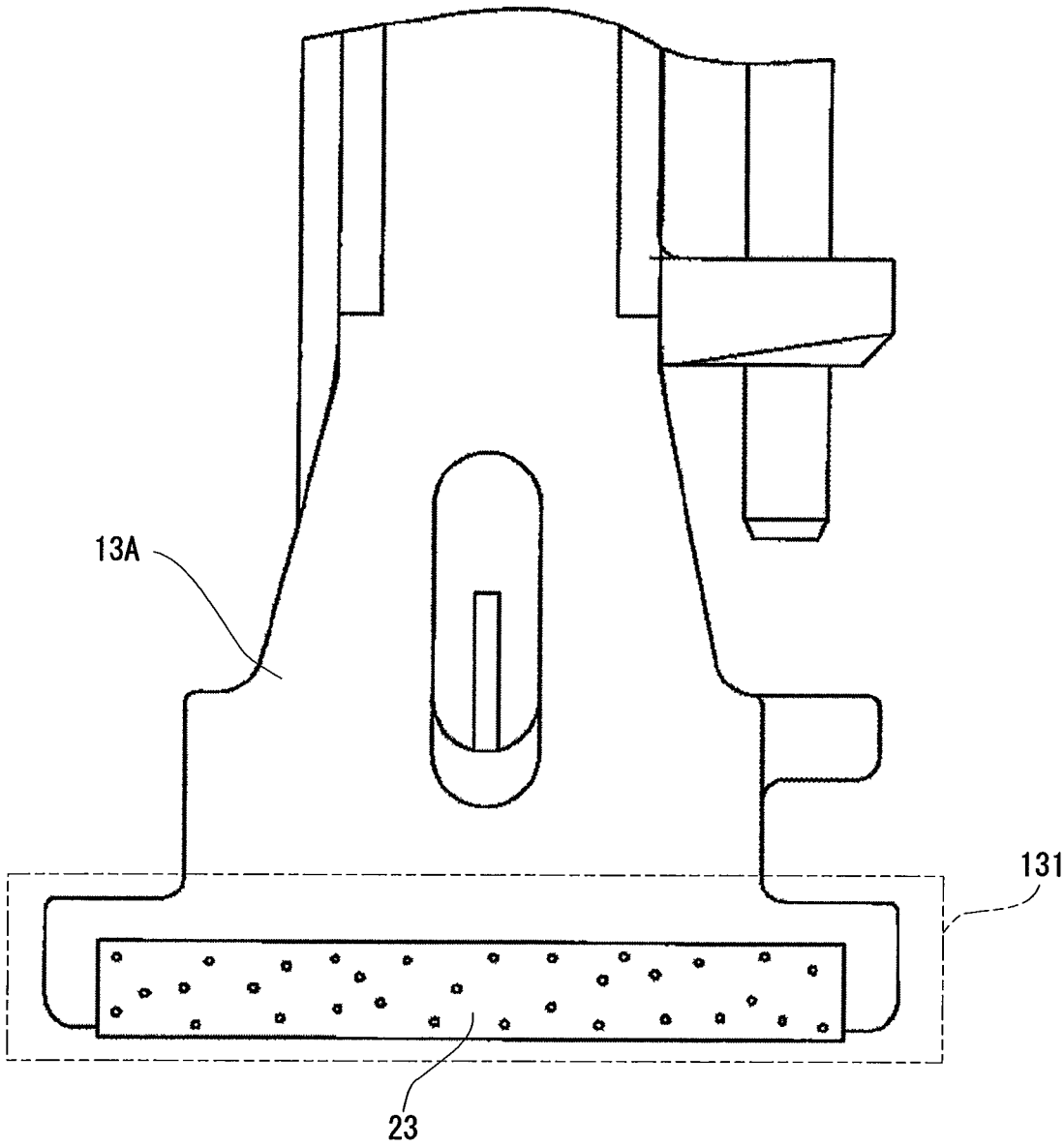
FIG. 6 is a front view illustrating the lower end of a push lever of the fastening machine in a second embodiment of the present invention.
Figure 7:
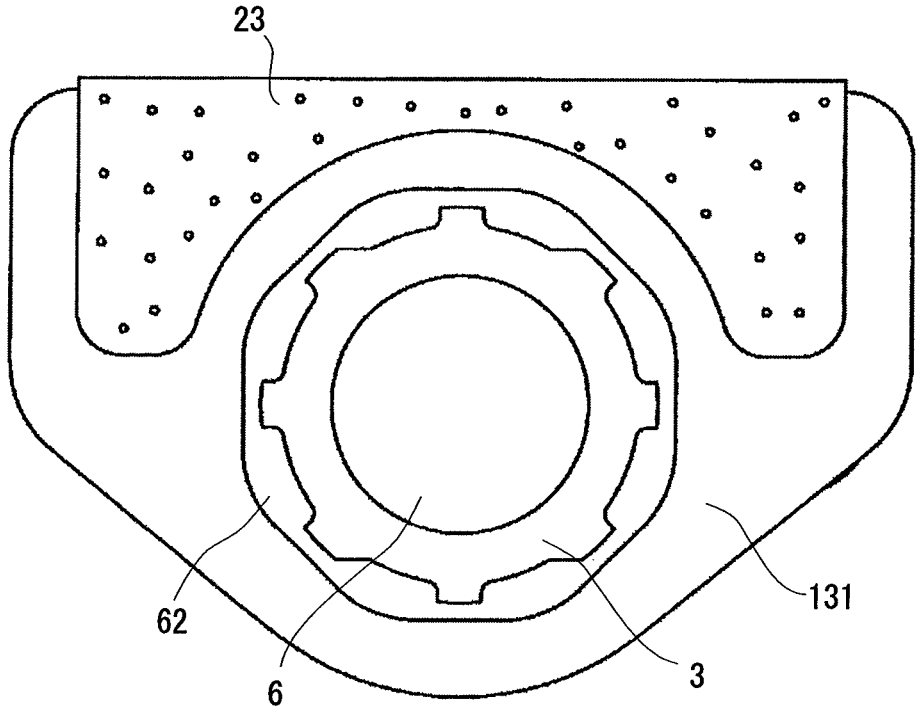
FIG. 7 is a bottom plan view illustrating the lower end of a push lever of the fastening machine in FIG. 6.
Figure 8:
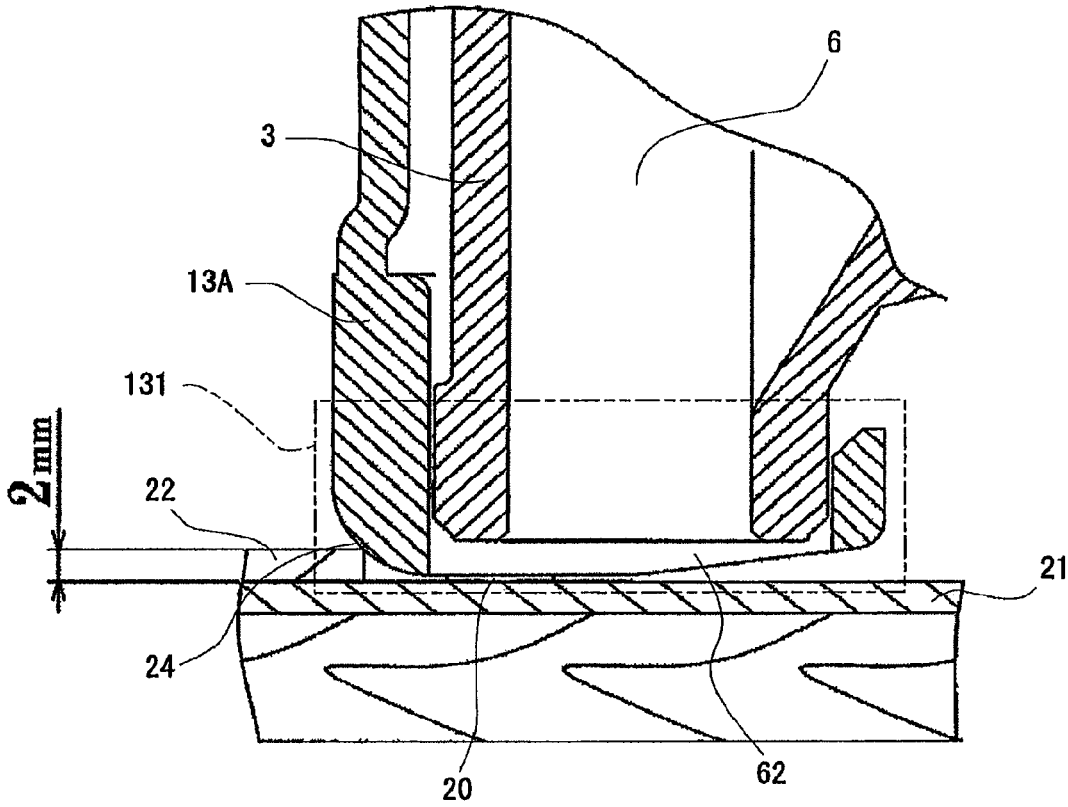
FIG. 8 PRIOR ART
FIG. 8 is a sectional side view illustrating a work state in aligning a roof material by a fastening machine in a conventional example.

Other embodiment of the present invention is next described in reference with FIGS. 6 and 7.

The vertical cross-section of a tungsten carbide chip (hereinafter described as super-hard material member 23) related to a second embodiment is formed in a plate shape bent in an L-shape. Furthermore, the super-hard material member 23 extends in the right-left direction to the front surface in the lower end of push lever 13A in the surface facing a material 21 into which a fastener is to be driven as shown in FIG. 7 and the extended end extends up to the position to overlap with the ejecting mouth 6 in the front-back direction. In other words, the super-hard material member 23 has the end in the right-left direction extending backwards at the surface facing a material 21 into which a fastener is to be driven, forming an approximately inverted arch shape, in which the ejecting mouth 6 is its center. That is, the super-hard material member 23 is an integrated form, in which the super-hard material member 19 and a pair of super-hard material members 20 related to the first embodiment are connected to each other. The super-hard material member 23 is placed a concave portion provided on the surface of the tip member 131 at the lower end of push lever 13A and brazed as well. The back end of the super-hard material member 23 in the right-left direction is arranged such that it extends backwards from the front surface of the tip member 131 by a length corresponding to approximately one third of the width behind the position in the front-back direction in the surface of the tip member 131 facing a material into which a fastener is to be driven.

Use of such a super-hard material member 23 with an elongated shape could rupture the central portion of super-hard material member 23 by heating and cooling in metal brazing, since the coefficient of expansion differs in the tip member 131 and the super-hard material member 23. Thickness of the central portion of the super-hard material member 23 is formed 2.0 mm or more in order to prevent from rupturing.

Use of the super-hard material member 23 with such a shape can achieve the effect similar to the super-hard material members 19, 20 related to the first embodiment even with a small number of members.

Hereinbefore, the present invention is specifically described based on each embodiment, but not limited by the embodiment above and various variations are possible within a scope not departing from its summary.

For example, the tip member 131 in the present invention may be integrally constructed with the nose 3. A member to drive in is not limited to nails, but may also be staples, screws and the like, while the nail 25 has been used to drive into an asphalt shingle described in the embodiment above. The material into which the fastener is to be driven is not limited to an asphalt shingle, but may be sheathing boards, plywood and the like.

Furthermore, any material excellent with wear resistance may be used as the super-hard material member, while the super-hard material member arranged in the tip member 131 is formed with a tungsten carbide chip in the embodiments described above. For example, surface of the super-hard material member may be coated with a hard material itself such as alumina ($Al_2O_3$), titanium carbonitride (TiCN) and the like (by chemical vapor deposition (CVD) or physical vapor disposition (PVD)). Not only metal materials but also synthetic resins such as polyacetal, polybutylene terephthalate and the like may be used.

While only the case using a nail gun operated by compressed air as a source of power is described, a source of power is not limited to compressed air, but of course, a fastening machine with a gas-fired type power source or an electric motor as a source of power can be applied.

Various embodiments and changes may be made thereunto without departing from the broad spirit and scope of the invention. The above-described embodiments are intended to illustrate the present invention, not to limit the scope of the present invention. The scope of the present invention is shown by the attached claims rather than the embodiments. Various modifications made within the meaning of an equivalent of the claims of the invention and within the claims are to be regarded to be in the scope of the present invention.

The present Application claims the priority based on Japanese Patent Application No. 2007-256895 filed on Sep. 28, 2007, the contents of which are herein incorporated in its entirety.

What is claimed is:

1. A fastening machine comprising:

a housing;

a handle extended from the housing;

a driver blade which is driven by a drive mechanism installed within the housing to fire a fastener;

a nose with an ejecting mouth and an ejection passage extending from the housing which slidably guides the driver blade;

a tip member arranged at the end of the nose in the direction of ejecting the fastener and having an opening at the location corresponding to the ejecting mouth, and a first super-hard material member provided in a side of the tip member, the side facing a material into which a fastener is to be driven, and being opposite to the extending direction of the handle, wherein the tip member is made of a material different from that of the first super-hard material member, and wherein a part of the tip member located opposite to the extending direction of the handle has a substantially flat surface configured to align the material into which a fastener is to be driven.

2. The fastening machine according to claim 1, wherein the tip member further comprises at least a pair of second super-hard material members at both sides of the opening on the surface facing the material into which the fastener is driven.

3. The fastening machine according to claim 2, wherein the first super-hard material member and the second super-hard material member are protruded, respectively, in the same quantity in the direction of ejecting the fastener from the surface of the tip member facing a material into which a fastener is to be driven.

4. The fastening machine according to claim 2, wherein the tip member is provided with a third super-hard material member, wherein the first super-hard material member and the second super-hard material member are formed integrally with each other.

5. The fastening machine according to claim 2, wherein the first super-hard material member and the second super-hard material member are brazed using at least two or more kinds of brazing filler metals with different melting temperatures.

6. The fastening machine according to claim 5, wherein two or more kinds of brazing filler metals comprise a copper brazing filler metal and a silver brazing filler metal.

7. The fastening machine according to claim 1, wherein the first super-hard material member is extended longer than a width of the ejecting mouth of the nose, in the direction orthogonal to the direction of the ejection passage and the extending direction of the handle.

8. The fastening machine according to claim 1, wherein the first super-hard material member is extended in parallel to the ejection passage towards the housing.

9. The fastening machine according to claim 8, wherein the first super-hard material member is connected via a chamfered portion whose surface that is parallel to the ejection passage and opposite to the direction in which the handle extends has a predetermined radius of curvature with respect to the surface facing the material into which the fastener is driven, and the radius of curvature is smaller than thickness of the material into which the fastener is to be driven.

10. The fastening machine according to claim 9, characterized in which the radius of curvature is smaller than 2.0 mm.

11. The fastening machine according to claim 1, wherein the first super-hard material member is attached to the tip member by metal brazing.

12. The fastening machine according to claim 1, wherein the material of the first super-hard material member is harder than the material of the tip member.

13. The fastening machine according to claim 1, wherein the material of the first super-hard material member has a greater wear resistance than the material of the tip member.

14. The fastening machine according to claim 1, wherein the first super-hard material member is made of at least one of tungsten carbide, alumina, titanium carbonitride, polyacetal, and polybutylene terephthalate.

15. The fastening machine according to claim 14, wherein the first super-hard material member is made of tungsten carbide.

16. A fastening machine comprising:

a housing;

a handle extended from the housing;

a driver blade which is driven by a drive mechanism installed within the housing to fire a fastener;

a nose with an ejecting mouth and an ejection passage extending from the housing which slidably guides the driver blade;

a tip member arranged at the end of the nose in the direction of ejecting the fastener and having an opening at the location corresponding to the ejecting mouth, and a first super-hard material member provided in a side of the tip member, the side facing a material into which a fastener is to be driven, and being opposite to the extending direction of the handle, wherein the tip member is made of a material different from that of the first super-hard material member, and wherein the first super-hard material member is extended longer than a width of the ejecting mouth of the nose, in the direction orthogonal to the direction of the ejection passage and the extending direction of the handle.

* * * * *